US008827395B2

(12) United States Patent
Masunaga

(10) Patent No.: US 8,827,395 B2
(45) Date of Patent: Sep. 9, 2014

(54) IMAGE FORMING APPARATUS

(75) Inventor: Suguru Masunaga, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 169 days.

(21) Appl. No.: 13/517,795

(22) Filed: Jun. 14, 2012

(65) Prior Publication Data

US 2013/0002743 A1 Jan. 3, 2013

(30) Foreign Application Priority Data

Jun. 28, 2011 (JP) ..... 2011-142784

(51) Int. Cl.
*B41J 2/195* (2006.01)
*B41J 29/38* (2006.01)
*B41J 2/175* (2006.01)

(52) U.S. Cl.
CPC *B41J 2/175* (2013.01); *B41J 29/38* (2013.01); *B41J 2/17509* (2013.01); *B41J 2/17566* (2013.01); *B41J 2/17596* (2013.01)
USPC ..... 347/7; 347/85

(58) Field of Classification Search
USPC ..... 347/5–7, 84–86
See application file for complete search history.

(56) References Cited

U.S. PATENT DOCUMENTS

2002/0024543 A1* 2/2002 Kimura et al. ..... 347/7
2003/0210309 A1* 11/2003 Kimura et al. ..... 347/85
2011/0063344 A1* 3/2011 Satoh et al. ..... 347/7
2011/0164077 A1 7/2011 Masunaga

FOREIGN PATENT DOCUMENTS

| | | |
|---|---|---|
| JP | 6-183027 | 7/1994 |
| JP | 2005-14342 | 1/2005 |
| JP | 2005-59274 | 3/2005 |
| JP | 2005-138472 | 6/2005 |
| JP | 2007-15153 | 1/2007 |
| JP | 2007-130979 | 5/2007 |
| JP | 2008-132638 | 6/2008 |
| JP | 2009-23092 | 2/2009 |
| JP | 2009-23329 | 2/2009 |
| JP | 2009-274325 | 11/2009 |

* cited by examiner

*Primary Examiner* — Julian Huffman
*Assistant Examiner* — Sharon A Polk
(74) *Attorney, Agent, or Firm* — Cooper & Dunham LLP

(57) ABSTRACT

An image forming apparatus filling its head tank with an ink while printing even when a detector of the apparatus detects the filled tank by detecting a displacement member being displaced according to an amount of the ink remaining in the head tank.

12 Claims, 15 Drawing Sheets

IMAGE FORMING APPARATUS

CROSS-REFERENCE TO RELATED APPLICATIONS

This patent application is based on and claims priority pursuant to 35 U.S.C. §119 to Japanese Patent Application No. 2011-142784 filed on Jun. 28, 2011, in the Japanese Patent Office, the entire disclosure of which is hereby incorporated herein by reference.

FIELD OF THE INVENTION

The present invention relates to an image forming apparatus, particularly to an image forming apparatus including a recording head discharging a droplet and a head tank feeding the droplet to the recording head.

BACKGROUND OF THE INVENTION

As an image forming apparatus such as printers, facsimiles, copiers, plotters, their complex machines, etc., an image forming apparatus using liquid discharge recording methods using a recording head formed of a liquid (droplet) discharge head discharging an ink droplet such as inkjet recorder is known.

The image forming apparatus includes a head tank (subtank or buffer tank) feeding an ink to a recording head and including a negative pressure generator generating a negative pressure to prevent the ink from exuding or dripping from a nozzle of the recording head. The head tank includes a flexible (film) member forming a facing of an ink container containing an ink, a negative pressure generator including an elastic member biasing the flexible member outward, and an openable and closable opener for atmosphere opening the ink container up in the air to feed the ink from the ink container to the recording head.

Japanese Patent Nos. 4298474, 4190001 and 4155879 and Japanese published unexamined applications Nos. 2007-015153, 2007-130979, 2008-132638, 2009-023329, 2009-274325 and 2009-023092 disclose that the head tank includes a displacement member (detection member or detection filler) according to a displacement of the flexible member, when the opener for atmosphere is opened to feed the ink from a main tank to the head tank, a carriage is moved to a predetermined detecting position (tank filling position), a driver of the opener for atmosphere included in the apparatus is activated to open up the head tank in the air to fill the ink in the head tank, and a position where a detector of the apparatus detects the displacement member is the tank filling position.

In Japanese published unexamined application No. 2009-023092, in order to feed the ink even while printing, when an ink consumption when printing is not less than a first predetermined value, based on information relative to an ink amount fed from the main tank to the head tank, when the amount is not greater than a second predetermined value, the ink is fed from the main tank to the head tank, and when the amount is greater than the second predetermined value, the ink is not fed from the main tank to the head tank.

Japanese Patent No. 3219326 discloses feeding an ink even while printing with an ink amount detector remaining in the head tank.

As mentioned above, when the head tank includes a displacement member being displaced according to an amount of the ink remaining in the head tank and the filled head tank is detected by the apparatus, the carriage needs to move the predetermined tank filling position where the ink is fed from the main tank to the head tank. Therefore, printing needs stopping when the amount of the ink in the head tank remains less, resulting in low printing speed.

In this case, the ink consumption in the head tank is calculated by counting the number of discharged droplets, and the ink can be fed from the main tank in an amount equivalent to the consumption. However, the tank filling position is not precisely detected, and it is possible that a short feed causes an excessive negative pressure or an excessive feed causes a low negative pressure. Therefore, the carriage needs to be periodically placed at the tank filling detection position to open up the tank in the air, and printing needs stopping, still resulting in low printing speed.

A member or a means required to control feeding the ink to the head tank is thought installed on the carriage, e.g., a detector detecting the amount of the ink remaining in the head tank or a driver driving the opener for atmosphere thereof is equipped on the carriage. However, this increases the weight of the carriage or enlarges the carriage, resulting in enlargement of the apparatus.

Because of these reasons, a need exists for filling the head tank with an ink while printing even when a detector of the apparatus detects the filled tank by detecting a displacement member being displaced according to an amount of the ink remaining in the head tank.

SUMMARY OF THE INVENTION

Accordingly, one object of the present invention to provide an image forming apparatus filling its head tank with an ink while printing even when a detector of the apparatus detects the filled tank by detecting a displacement member being displaced according to an amount of the ink remaining in the head tank.

This object of the present invention has been satisfied by the discovery of an image forming apparatus, comprising:

a recording head configured to discharge a droplet;

a head tank configured to contain a liquid fed to the recording head;

a carriage configured to mount the recording head and the head tank;

a main tank configured to contain the liquid fed to the head tank;

a liquid feeder configured to feed the liquid from the main tank to the head tank; and a feed controller configured to control feeding of the liquid from the main tank to the head tank, wherein the head tank comprises a displacement member configured to be displaced according to an amount of the liquid remaining therein;

the carriage comprises a first detector configured to detect the displacement member; and the image forming apparatus comprises a second detector configured to detect the displacement member, wherein a first position of the displacement member detected by the first detector is a position when an amount of the liquid remaining in the head tank is less than that thereof remaining therein at a second position of the displacement member detected by the second detector, and the feed controller detects a displacement amount of the displacement member between the first and second positions, holds a difference displacement amount or a difference feed amount equivalent thereto, which is determined by reducing a predetermined displacement amount from the detected displacement amount, starts feeding the liquid from the main tank to the head tank after the displacement member is displaced in a direction of decrease of the liquid amount remaining in the head tank and a consumption of the liquid in the head tank after the first detector detects the displacement member becomes a predetermined liquid consumption, and feeds the liquid to the head tank in the difference feed amount equivalent to the difference displacement amount after the displacement member is displaced in a direction of increase of the liquid amount remaining in the head tank and the first detector detects the displacement member.

This object, features and advantages of the present invention will become apparent upon consideration of the following description of the preferred embodiments of the present invention taken in conjunction with the accompanying drawings.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein.

DETAILED DESCRIPTION OF THE INVENTION

The present invention provides an image forming apparatus filling its head tank with an ink while printing even when a detector of the apparatus detects the filled tank by detecting a displacement member being displaced according to an amount of the ink remaining in the head tank.

More particularly, the present invention relates to an image forming apparatus, comprising:

a recording head configured to discharge a droplet;

a head tank configured to contain a liquid fed to the recording head;

a carriage configured to mount the recording head and the head tank;

a main tank configured to contain the liquid fed to the head tank;

a liquid feeder configured to feed the liquid from the main tank to the head tank; and a feed controller configured to control feeding of the liquid from the main tank to the head tank, wherein the head tank comprises a displacement member configured to be displaced according to an amount of the liquid remaining therein;

the carriage comprises a first detector configured to detect the displacement member; and the image forming apparatus comprises a second detector configured to detect the displacement member, wherein a first position of the displacement member detected by the first detector is a position when an amount of the liquid remaining in the head tank is less than that thereof remaining therein at a second position of the displacement member detected by the second detector, and the feed controller detects a displacement amount of the displacement member between the first and second positions, holds a difference displacement amount or a difference feed amount equivalent thereto, which is determined by reducing a predetermined displacement amount from the detected displacement amount, starts feeding the liquid from the main tank to the head tank after the displacement member is displaced in a direction of decrease of the liquid amount remaining in the head tank and a consumption of the liquid in the head tank after the first detector detects the displacement member becomes a predetermined liquid consumption, and feeds the liquid to the head tank in the difference feed amount equivalent to the difference displacement amount after the displacement member is displaced in a direction of increase of the liquid amount remaining in the head tank and the first detector detects the displacement member.

Figure 1:
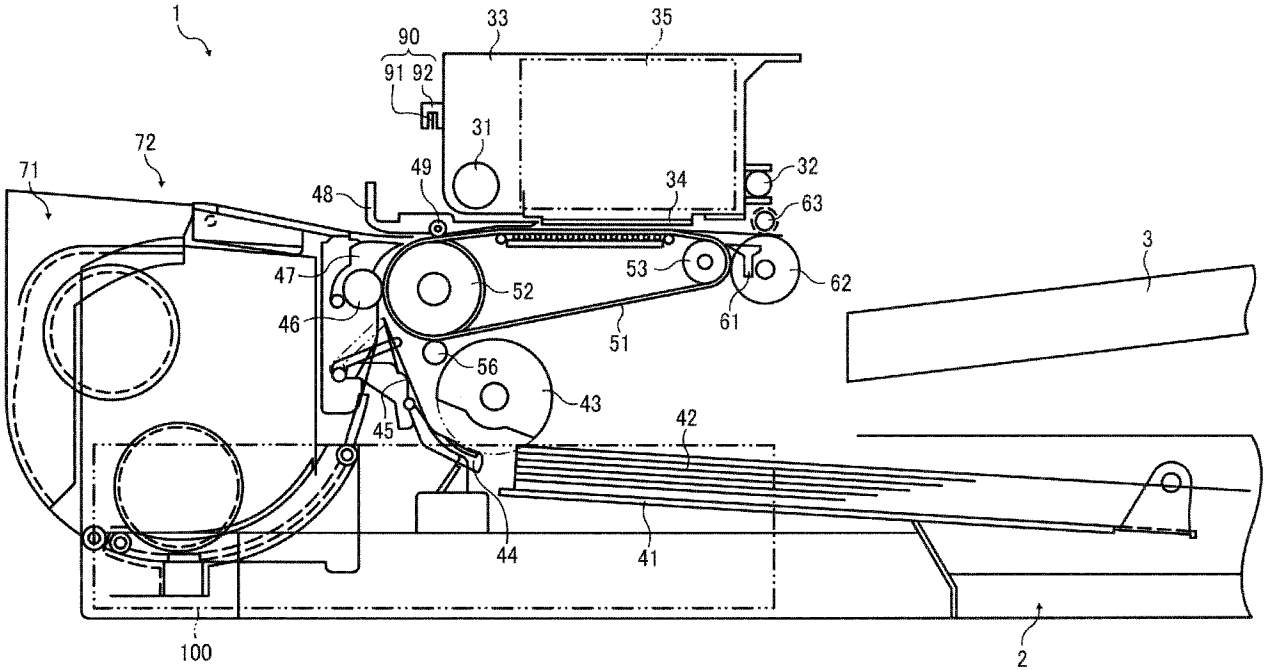
FIG. 1 is a schematic side view for explaining a configuration of a first embodiment of the image forming apparatus of the present invention.
Figure 2:
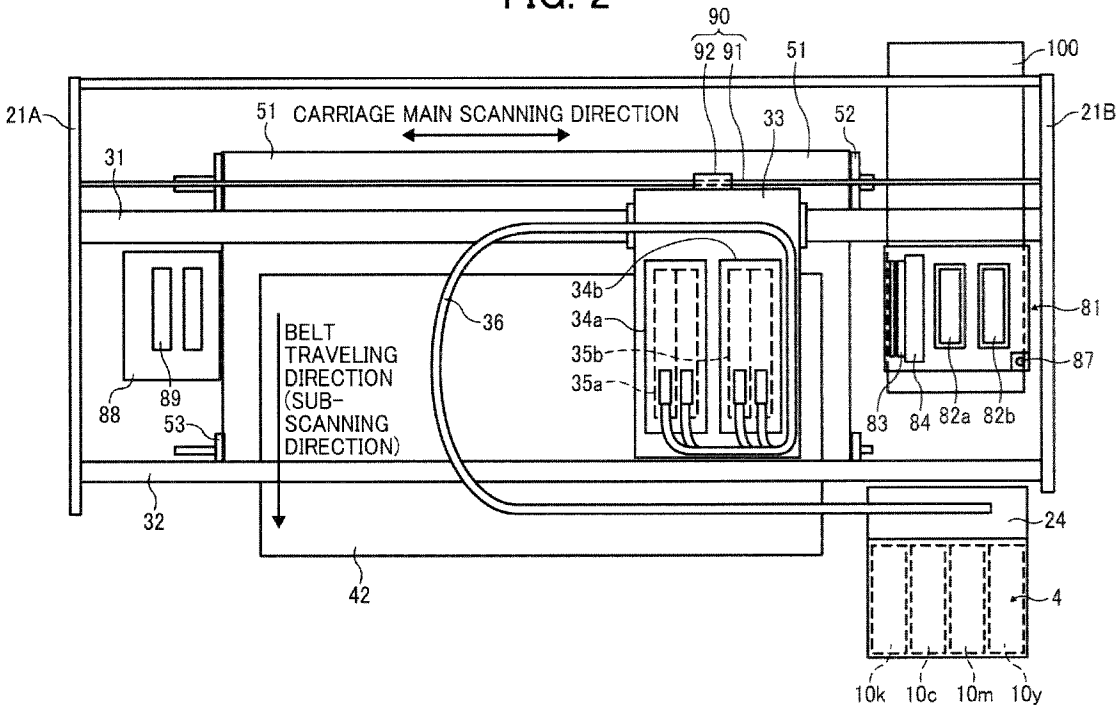
FIG. 2 is a schematic plain view for explaining the main part of the configuration in FIG.1.

Hereinafter, the embodiments of the present invention are explained, referring to the drawings. An embodiment of the image forming apparatus of the present invention is explained, referring to FIGS. 1 and 2. FIG. 1 is a schematic side view for explaining a whole configuration of the image forming apparatus, and FIG. 2 is a schematic plain view for explaining the main part thereof This image forming apparatus is a serial-type inkjet recorder, and a carriage 33 is slidably held in a scanning direction by a main and a sub-guide rods 31 and 32 as guide members laterally bridged on eight and left side boards 21A and 21B of an apparatus 1, and a main scanning motor mentioned later moves the carriage in the main scanning direction to scan through a timing belt.

The carriage 33 includes recording heads 34*a* and 34*b* (recording head 34 when not discriminated) each formed of a droplet discharge head discharging an ink drop of each yellow (Y), cyan (C), magenta (M) and black (K) color, including nozzle lines formed of plural nozzles in a sub-scanning direction perpendicular to the main scanning direction to discharge the ink drop downward.

The recording head 34 includes two nozzle lines, one nozzle line of the recording head 34*a* discharges a black (K) droplet and the other nozzle line thereof discharges a cyan (C) droplet, and one nozzle line of the recording head 34*b* discharges a magenta (M) droplet and the other nozzle line thereof discharges a yellow (Y) droplet.

The carriage 33 mounts head tanks 35*a* and 35*b* (head tank 35 when not discriminated) feeding each color ink to the nozzle line of the recording head 34. From ink cartridges 10*y*, 10*m*, 10*c* and 10*k* as main tanks for each color detachable from a cartridge loader 4, a recording liquid for each color is fed to the head tank 35 by a feed pump unit 24 through a feed tube 36 for each color.

An encoder scale 91 is located along the main scanning direction of the carriage 33, and the carriage 33 includes an encoder sensor 92 reading the encoder scale 91. The encoder scale 91 and the encoder sensor 92 form a linear encoder 90 producing a detection signal to detect a (carriage) position in the main scanning direction and a travel distance of the carriage 33.

To feed a sheet 42 loaded on a sheet loader (thick plate) 41 of a sheet feed tray 2, a half-moon shaped (sheet feed) roller 43 separating the sheet 42 from the sheet loader 41 one by one to feed and a separation pad 44 formed of a material having a large friction coefficient facing the sheet feed roller 43, and the separation pad 44 is biased toward the sheet feed roller 43.

To feed the sheet 42 below the recording head 34, a guide member 45 guiding the sheet 42, a counter roller 46, a feed guide member 47, a pushing member 48 having an end pressure roller 49, and a feed belt 51 electrostatically adsorbing the sheet 42 to feed to a position facing the recording head 34.

The feed belt 51 is an endless belt supported by a feed roller 52 and a tension roller 53 and rotates in a belt travelling (sub-scanning) direction. A charging roller 56 as a charger is located to charge the surface of the feed belt 51. The charging roller 56 contacts a surface layer of the feed belt 51 and is driven by rotation of the feed belt 51 to rotate. The feed belt 51 rotates in a belt travelling direction when the feed roller 52 is driven to rotate by a sub-scanning motor mentioned later.

To discharge the sheet 42 recorded by the recording head 34, a separation click 61 separating the sheet 42 from the feed belt 51, a sheet discharge roller 62 and a spur 63, and a discharged sheet tray 3 below the sheet discharge roller 62 are located.

The apparatus 1 includes a detachable both side unit 71 on its back. The both side unit 71 reverses the sheet 42 returned by reverse rotation of the feed belt 51 to feed the sheet 42 between the counter roller 46 and the feed belt 51 again. An upper side of the both side unit 71 is a manual tray 72.

Further, at a non-image area in the main scanning direction of the carriage 33, a sustention and resume mechanism 81 sustaining and resuming the nozzle of the recording head 34 is located. The sustention and resume mechanism 81 includes cap members (hereinafter referred to as "caps") 82 a and 82*b* (cap 82 when not discriminated), a wiper member (blade) 83 wiping the nozzle face, a blank discharge receiver 84 receiving a droplet when a blank discharge is made to discharge a droplet not serving for recording for discharging a thickened recording liquid, a carriage lock 87 locking the carriage 33, etc. An exchangeable waste liquid tank 100 containing a waste liquid caused by the sustention and resume operation is located below the sustention and resume mechanism 81.

At the other non-image area in the main scanning direction of the carriage 33, a blank discharge receiver 88 receiving a droplet when a blank discharge is made to discharge a droplet not serving for recording for discharging a recording liquid thickened while printing is located, which includes an opening 89 along the nozzle line of the recording head 34.

In the image forming apparatus, the sheet 42 is separated and fed from the sheet feed tray 2 one by one. The sheet 42 fed upward almost vertically is guided by the guide member 45 and fed while sandwiched between the feed belt 51 and the counter roller 46. Further, an end of the sheet 42 is guided by a feed guide 37 and pressed to the feed belt 51 by the end pressure roller 49 to be fed in a direction changed by almost 90°.

Then, an alternating voltage is applied to the charging roller 56 to alternately repeat positively charging and negatively charging the feed belt 51 to positively and negatively be charged in the rotational (sub-scanning) direction at a predetermined width in alternate shifts in the shape of a band. When the sheet 42 is fed on the feed belt 51 positively and negatively charged in alternate shifts, the sheet 42 is adsorbed to the feed belt 51 and fed in the sub-scanning direction by the rotation thereof.

Then, the recording head 34 is driven according to an image signal to discharge an ink drop on the sheet 42 at a stop for recording one line thereon while the carriage 33 travels, and the next line is recorded after the sheet 42 is transferred for a predetermined distance. A recording completion signal or a signal representing a back end of the sheet 42 reaches a recording area quits recording and discharge the sheet 42 onto the discharged sheet tray 3.

When the nozzle of the recording head 34 is sustained and resumed, the carriage 33 is moved to a position facing the sustention and resume mechanism 81, i.e., a home position of the carriage 33, where the sustention and resume operation such as capping by the cap member 82 to suction the nozzle and blank discharge to discharge a droplet not serving for recording is performed to stably discharge a droplet for image formation.

Figure 3:
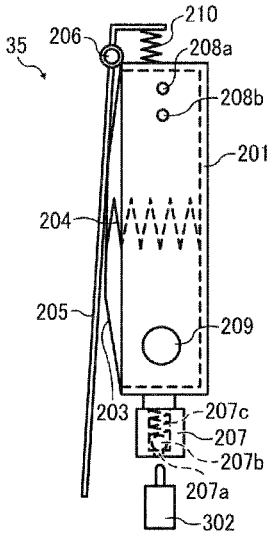
FIG. 3 is a schematic plain view for explaining an embodiment of the head tank.
Figure 4:
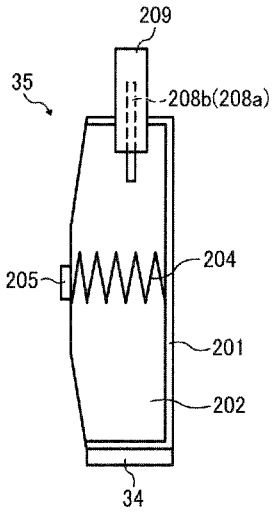
FIG. 4 is a schematic cross-sectional front view for explaining the head tank in FIG. 3.

Next, an embodiment of the head tank 35 is explained, referring to FIGS. 3 and 4. FIG. 3 is a schematic top view for explaining the head tank 35 and FIG. 4 is a schematic front view for explaining the head tank 35.

The head tank 35 includes a tank case 201 forming an ink container opening one side to hold an ink, an opening of the tank case 201 is sealed with a flexible film 203 to from an ink container 202, and a spring 204 located in the tank case 201 constantly biases the flexible film 203 outward. The film 203 of the tank case 201 is applied with a biasing force outward by the spring 204, and when the ink in the ink container 202 of the tank case 201 decreases, a negative pressure is generated.

A displacement member 205 (hereinafter referred to as a "filler"), one end of which is swingably supported by a support axis 206, and biased toward the tank case 201 by the spring 210 is fixed on the film 203 on the outside of the tank case 201. The displacement member 205 is displaced in conjunction with movement of the flexible film 203.

The displacement member 205 is detected by a first detector 251 located on the carriage 33 or a second detector 301 located in the apparatus mentioned later to detect an amount of the ink remaining in the head tank 35 or a negative pressure, A feed opening part 209 is located on the top of the tank case 201, through which an ink is fed from the ink cartridge 10 and connected to an ink feed tube 36. An opener for atmosphere 207 opening the inside of the head tank 35 is located on the side of the tank case 201.

The opener for atmosphere 207 includes a valve 207*b* opening and closing a path for atmosphere 207*a* connected with the inside of the head tank 35, and a spring 207*c* biasing the valve 207*b* to close. A solenoid 302 pushes the valve 207*b* to open such that the inside of the head tank 35 is open (connected) to the atmosphere.

The head tank 35 includes electrode pins 208*a* and 208*b* detecting an ink level. The ink is electroconductive, and when the ink reaches the electrode pins 208*a* and 208*b*, a current flows therebetween and their resistivities change to detect the ink level is not higher than a predetermined level, i.e., an air amount in the head tank 35 is not less than a predetermined amount.

Figure 5:
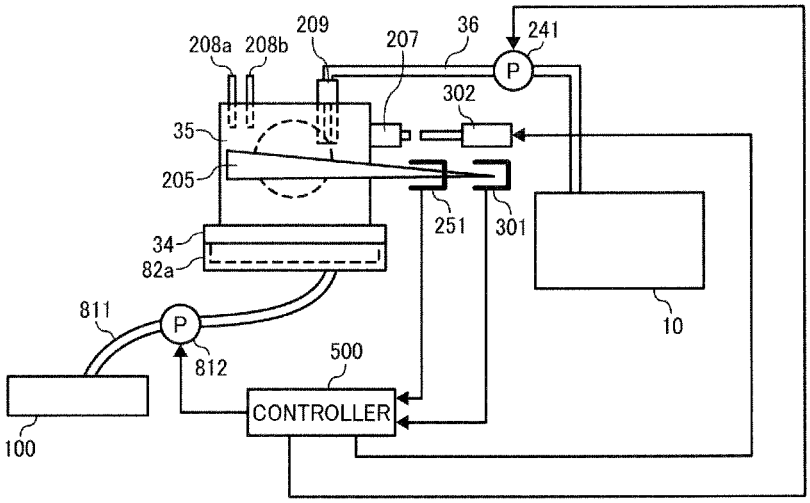
FIG. 5 is a schematic view for explaining an ink feed discharge system.

Next, an ink feed and discharge system in the image forming apparatus is explained, referring to FIG. 5.

First, an ink is fed from an ink cartridge (hereinafter referred to as a "main tank") 10 to the head tank 35 by a liquid feed pump 241 as a liquid feeder of the feed pump unit 24 through the feed tube 36. The feed pump 241 is a reversible pump formed of a tube pump capable of feeding an ink from the ink cartridge 10 to the head tank 35 and returning the ink therefrom to the ink cartridge 10.

The sustention and resume mechanism 81, as mentioned above, includes the suction cap 82*a* capping the nozzle face of the recording head 34 and a suction pump 812 connected with the suction cap 82*a*. The suction pump 812 is driven while the nozzle is capped with the cap 82*a* to suction the ink from the nozzle and in the head tank 35 through a suction tube 811. The suctioned waste ink is discharged into a waste liquid tank 813.

The apparatus includes the solenoid 302 as a pressure member opening and closing the opener for atmosphere 207 of the head tank 35

Further, the carriage 33 includes the first detector 251 formed of an optical sensor detecting the displacement member 205, and the apparatus includes the second detector 301 formed of an optical sensor detecting the displacement member 205. As mentioned later, an operation of feeding the ink to the head tank 35 is controlled, based on the detection results of the first detector 251 and the second detector 301.

The drive control of the liquid feed pump 241, the solenoid 302 and the suction pump 812, and the ink feed control in the present invention is performed by a controller 500.

Figure 6:
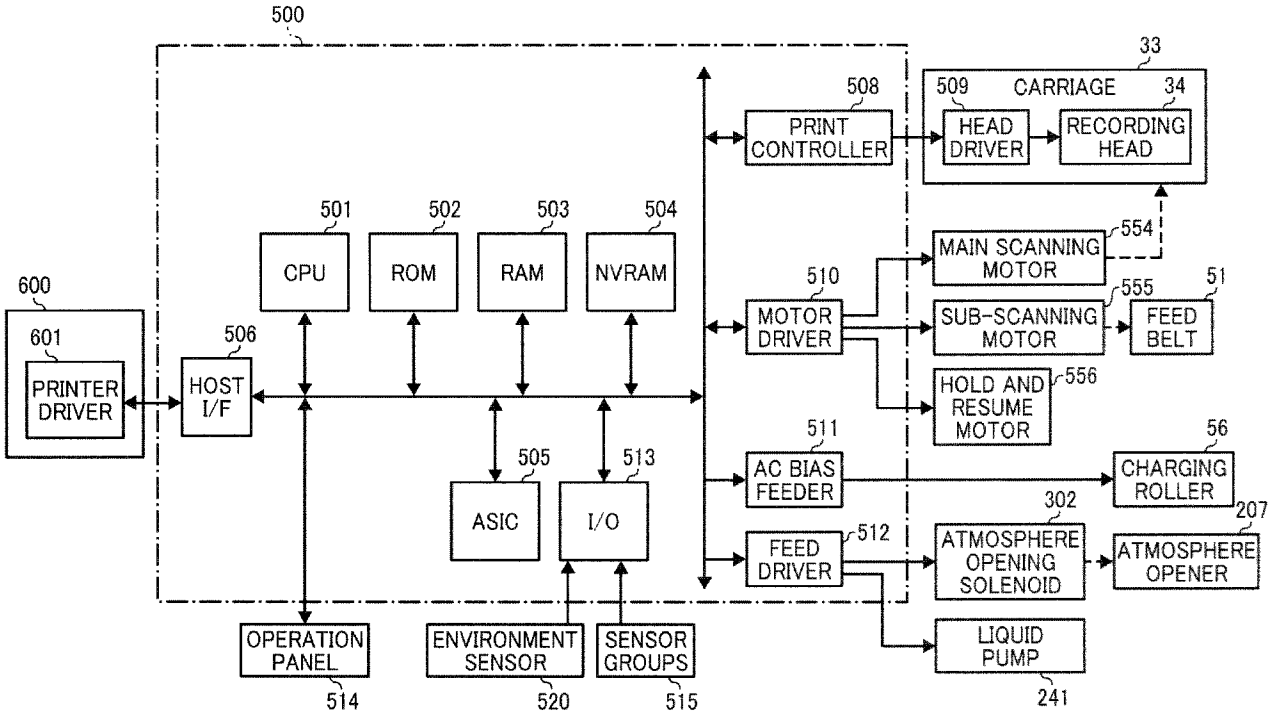
FIG. 6 is a block diagram explaining an outline of the controller of the image forming apparatus.

Next, the outline of the controller in the image forming apparatus is explained, referring to FIG. 6. FIG. 6 is a block diagram explaining an outline of the controller.

The controller 500 controls the whole apparatus, and includes a CPU 501 serving as the feed controller of the present invention as well, a ROM 502 containing fixed data, a RAM 502 temporarily containing image data, etc., a non-volatile memory 504 serving as a rewritable memory holder holding data even while the apparatus is shut down as well, and an ASIC 505 executing various signals processing relative to image data, image, image processing such as sorting and other controls of the whole apparatus.

Further, the controller 500 includes a data transferer for drive control of the recording head 34, a print controller 508 including a drive signal generator, a head driver (driver IC) 509 driving the recording head 34 formed on the carriage 33, a main scanning motor 554 moving the carriage 33, a sub-scanning motor 555 rotating the feed belt 51, a motor driver 510 driving a sustention and resume motor 556 of the sustention and resume mechanism 81, an AC bias applicator 511 applying an AC bias to the charging roller 56, and a feed driver 512 driving the solenoid 302 formed on the apparatus opening and closing the opener for atmosphere 207 of the head tank 35 and the liquid feed pump 241.

operation panel 514 entering displaying information required for the apparatus is connected with the controller 500.

The controller 500 includes an I/F 506 transferring and receiving data and signals to and from a host, the I/F 506 receives them from the host 600, e.g., image processors such as PCs, image readers such as image scanners and imaging devices such as digital cameras though a cable or a network.

The CPU501 of the controller 500 reads out and analyzes print data in a received buffer included in the I/F 506, ASIC 505 executes image processing, sorting, etc. required, and the print controller 508 transfers the image data to the head driver 509. Dot pattern data are produced by a printer driver 601 of the host 600.

The print controller 508 transfers the image data as serial data, a transfer clock and a clutch signal required to transfer the image data and confirm the transfer to the head driver 509, includes a D/A convertor converting pattern data of a drive pulse contained in the ROM, a voltage amplifier and a drive signal generator formed of a current amplifier, and transfers a drive signal formed of a drive pulse or plural drive pulses to the head driver 509.

The head driver 509, based on the serially-entered image data equivalent to one line of the recording head 34, selectively applies a drive pulse forming a drive signal from the print controller 508 to a drive element such as a piezoelectric element generating an energy for discharging a droplet from the recording head 7 to dive drive the recording head. Then, the drive pulse forming the drive signal is selected to form dots having different sizes such as a large drop, a medium drop and a small drop.

An I/O 513 obtains information from various sensors 515 installed in the apparatus to extract information required to control the apparatus, which are used to operate the print controller 508 and the motor driver 510, and control the AC bias applicator 511 and ink feed to the head tank 35.

The sensors include an optical sensor detecting a sheet position, a thermistor (environmental temperature sensor and environmental humidity sensor) monitoring temperature and humidity in the apparatus, a sensor monitoring a voltage of the charged belt, interlock switches detecting opening and closing of a cover besides the above-mentioned first detector 251, second detector 302, and electrode pins 208*a* and 208*b*, and the I/O 513 processes various sensor information.

Figure 7:
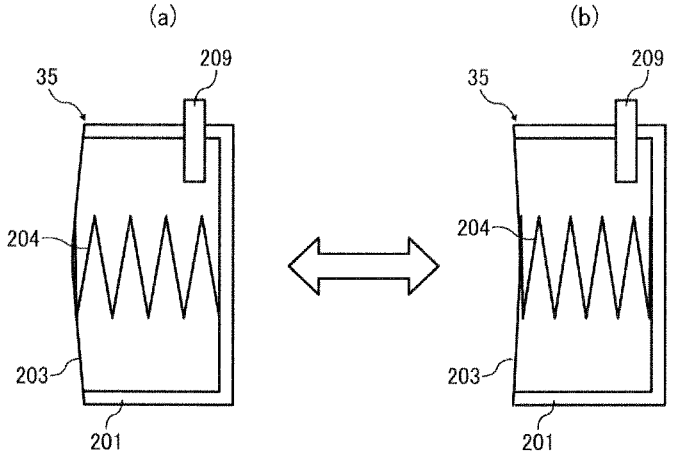
FIGS. 7A and 7B are schematic views for explaining a negative pressure forming operation of the head tank.

Next, a negative pressure formation of the head tank 35 in the image forming apparatus is explained, referring to FIG. 7.

As FIG. 7A shows, after the ink is fed from the main tank 10 to the head tank 35, as mentioned above, the ink is suctioned therefrom or the recording head 34 is driven to discharge a drop (blank discharge discharging a droplet not serving for image formation) to decrease the ink in the head tank 35. As FIG. 7B shows, the flexible film 203 is displaced against a biasing force of the spring 204, and a negative pressure is generated thereby in the head tank 35.

Further, when the liquid feed pump 241 suctions the inside of the head tank 35, the flexible film 203 is drawn into the head tank 35 and the spring 204 is further compressed to increase the negative pressure.

When the ink is fed into the head tank 35, the flexible film 203 is pushed out of the head tank 35 and the spring 204 is extended to decrease the negative pressure.

These operations are repeated to hold a constant negative pressure in the head tank 35.

Figure 8:
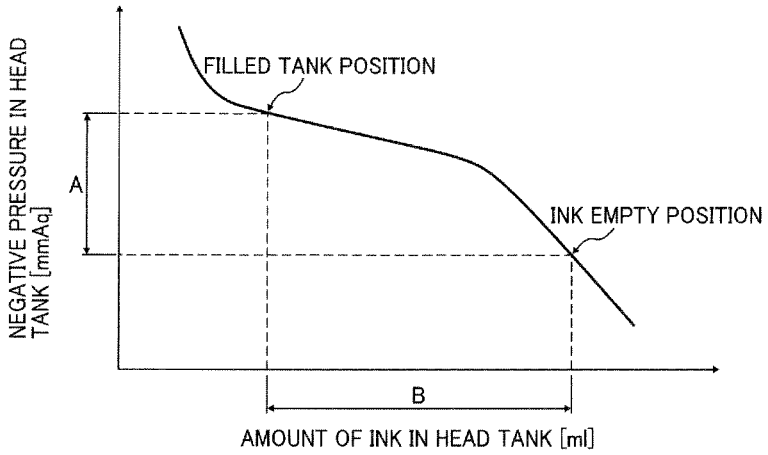
FIG. 8 is a diagram for explaining a relationship between the negative pressure and an amount of the ink in the head tank.

Namely, as FIG. 8 shows, the negative pressure and the ink amount in the head tank 35 are correlative, and when the ink amount therein is large, the negative pressure therein is small. When the ink amount therein is small, the negative pressure therein is large. When the negative pressure therein is too small, the ink is likely to leak from the recording head 34. When too strong, air and dusts are likely to be mixed in from the recording head 34, resulting in poor discharge.

Therefore, the ink in the head tank 35 is controlled to have an amount within an ink amount B such that the negative pressure therein is within a predetermined negative pressure A. Hereinafter, an ink amount in the head tank 35 equivalent to the minimum value of the negative pressure A (the negative pressure is small and the ink amount is large) is described as "filled tank position" by a displacement position of the displacement member 205, and an ink amount in the head tank 35 equivalent to the maximum value of the negative pressure A (the negative pressure is large and the ink amount is small) is described as "ink empty position" by a displacement position of the displacement member 205.

Figure 9:
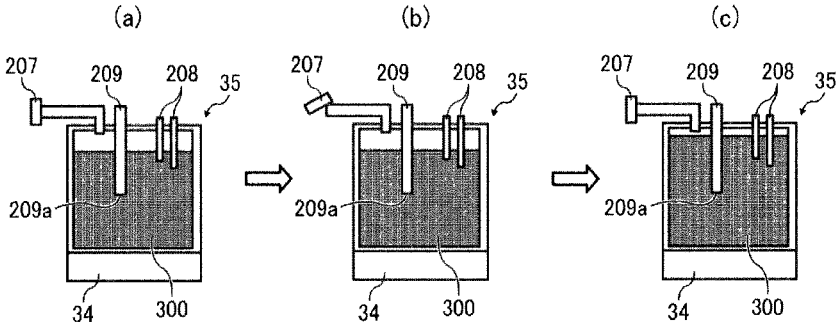
FIGS. 9A, 9B and 9C are schematic views for explaining a method of setting a displacement member of the head tank at a position opened to the atmosphere.

Next, a method of setting the displacement member 205 of the head tank 35 at a position opened to the atmosphere is explained, referring to FIG. 9. The head tank 35 is schematically shown therein, different from FIGS. 3 and 4.

First, from the status shown in FIG. 9, the opener for atmosphere 207 is opened to release the negative pressure in the head tank 35 to lower the liquid level therein as FIG. 9B shows. Then, the feed opening part 209 preferably has a feed opening 209*a* below the liquid level.

When the feed opening 209*a* is above the liquid level, air is mixed in the feed tube 26 through the feed opening part 209 or the feed opening 209*a*. When the ink is fed next, an air bubble is occasionally discharged with the ink from the feed opening 209*a*. If the ink is continuously fed, the air bubble adheres to the inside of the opener for atmosphere 207, resulting in possible malfunction of the valves and liquid leakage.

Then, the negative pressure of the head tank 35 is released, and after the liquid level lowers, an ink 300 is fed as FIG. 9C shows. When the ink 300 is fed, the liquid level rises until the electrode pins 208*a* and 208*b* detects the liquid level at a predetermined height, i.e., the ink 300 is fed until reaching a predetermined point. Then, a position where the displacement member 205 of the head tank 35 stands at is a position opened to the atmosphere.

Figure 10:
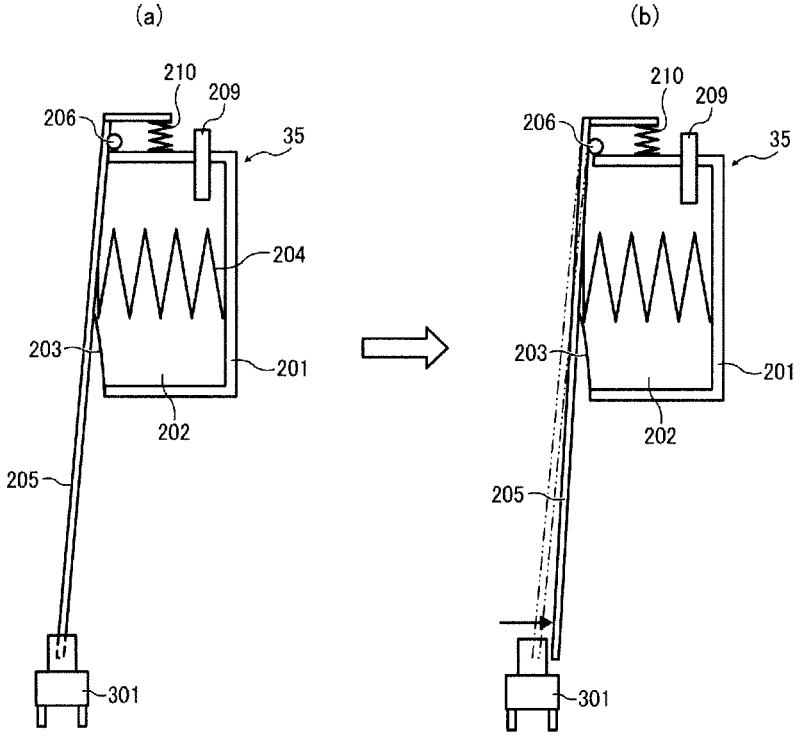
FIGS. 10A and 10B are schematic views for explaining detection of a displacement amount of the displacement member of the head tank.

Next, detection of a displacement amount of the displacement member 205 of the head tank 35 is explained, referring to FIG. 10. Here, a detection of a displacement amount using only the second detector 301 is explained.

As FIG. 10A shows, a position of the carriage 33 (obtained by the linear encoder 90) is memorized when the second detector 301 detects the displacement member 205 of the head tank 35, and when the displacement member 205 moves to a position in broken line from a position in solid line as FIG. 10B shows, the carriage 33 is relatively moved until the second detector 301 detects the displacement member 205, and a difference with the memorized carriage position (carriage displacement) is a displacement of the displacement member 205.

Next, a method of setting the ink amount in the head tank 35 at the filled tank position.

As mentioned above, after the opener for atmosphere 207 is opened such that the head tank 35 has an atmospheric pressure, the ink is fed to a predetermined position when the electrode pin 208 detects the liquid level to close the opener for atmosphere 207, and then the displacement member 205 has an atmosphere opening position.

The second detector 301 detects the displacement member 205 of the head tank 35 is at the atmosphere opening position, a carriage scanning is performed from the carriage position for a predetermined count value L, and the ink is returned into the main tank 10 until the second detector 301 detects the displacement member 205. Then, the position is the filled tank position.

Namely, the filled tank position is set at a position where the displacement member 205 is displaced from the atmosphere opening position by a predetermined displacement amount. Thus, the filled tank position in consideration of the negative pressure can be set, the displacement member 205 has no variability from the atmosphere opening position to the filled tank position, and the operation controlled by the displacement amount of the displacement member 205 can precisely be controlled.

Figure 11:
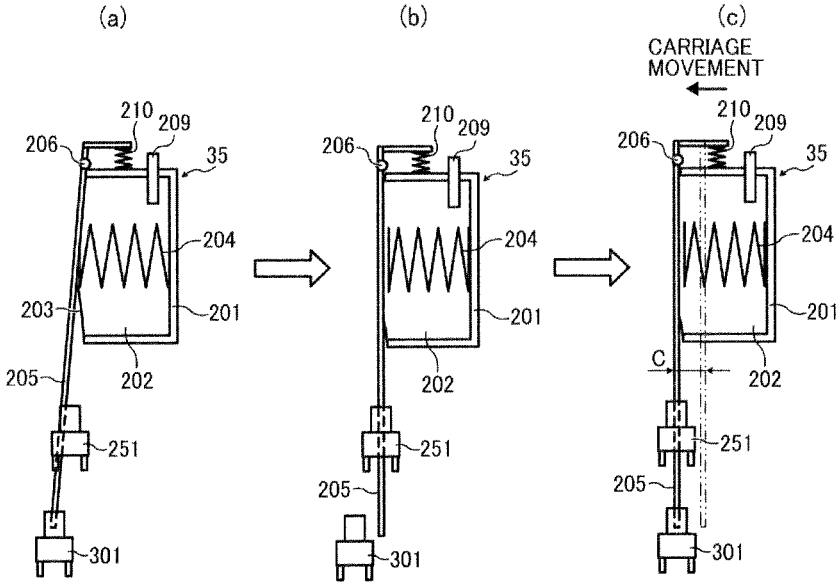
FIGS. 11A, 11B and 11C are schematic views for explaining a method of detecting a displacement amount (difference) of the displacement member between a first position when a first sensor detects the displacement member and a second position when a second sensor detects the displacement member.

Next, a method of detecting a displacement amount (difference) between a first position when the first detector 251 detects the displacement member 205 and a second position when the second detector 301 detects the displacement member 205 is explained, referring to FIG. 11.

As FIG. 11A shows, the carriage 33 is moved to a position where the second detector 301 can detect the displacement member 205, and as FIG. 11B shows, when the displacement member 205 is at the atmosphere opening position or the filled tank position, the liquid feed pump 241 reverses to suction the ink until the first detector 251 detects the displacement member 205 and stops reversing.

As FIG. 11C shows, while the first detector 251 detects the displacement member 205, the carriage 33 is moved until the second detector 301 detects the displacement member 205, and the travel distance is counted by the linear encoder 90 to obtain a displacement amount (difference) of the flexible film 203 or the displacement member 205 from the atmosphere opening position or the filled tank position until the first detector 251 detects the displacement member 205.

Next, the control of feeding an ink to the head tank 35 without the using the second detector 301 is explained.

A displacement amount (difference) of a first position when the first detector 251 detects the displacement member 205 from the atmosphere opening position is detected, a predetermined displacement amount is reduced from the difference to determine a difference displacement amount, and a liquid amount equivalent to the difference displacement amount is memorized and stored in a non-volatile memory such as NVRAM 504 as a difference feed amount.

While the carriage 33 scans (while the image forming operation is performed), the displacement member 205 is displaced in a direction of decrease of the ink in the head tank 35, and when the ink consumption in the head tank 35 becomes a predetermined liquid consumption after the first detector 251 detects the displacement member 205, the ink is filled in the head tank 35 from the main tank 10. After the displacement member 205 of the head tank 35 is displaced in a direction of increase of the ink and the first detector 251 detects the displacement member 205, the ink in the difference feed amount is fed in the head tank 35 to the filled tank position.

In this case, the first detector 251 detects a position, and accumulation of detection errors such as detection errors of the ink discharge amount and the liquid feed amount by the liquid feed pump 241 disappear when the first detector 251 detects, and the ink discharge and the ink feed can repeatedly be performed even while the carriage 33 scans.

The displacement member 205 is displaced in a direction of decrease of the ink in the head tank 35, and the ink consumption therein after the first detector 251 detects the displacement member 205 is measured to decrease measurement error of the ink consumption by soft count mentioned later.

These operations are repeated to constantly fill the ink in the head tank 35 to the filled tank position without breaking the printing operation, which improves printing speed and efficiency.

Figure 12:
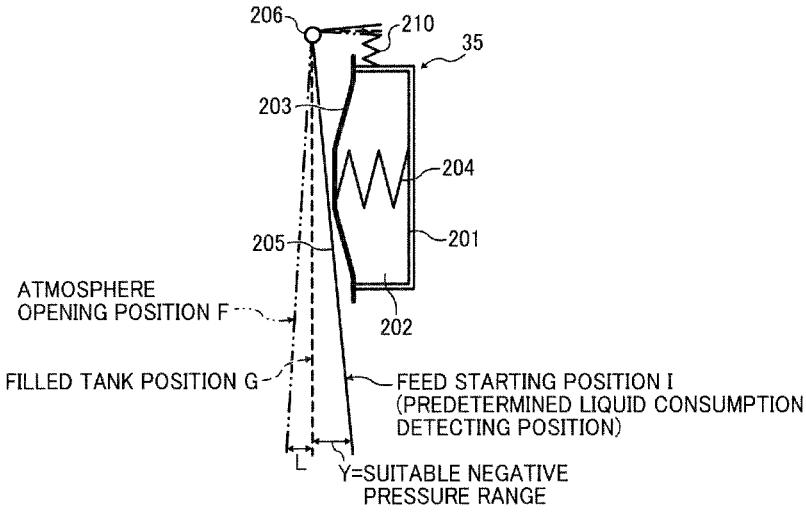
FIG. 12 a schematic view for explaining each position of the displacement member of the head tank.

The above-mentioned displacement position of the displacement member 205 of the head tank 35 is explained, referring to FIG. 12.

As FIG. 12 shows, the filled tank position (maximum ink amount value) G is a side having a small negative pressure and a feed starting position (minimum ink amount value) I is a side having a large negative pressure. The displacement of the displacement member 205 between the filled tank position G and the feed starting position I is a suitable negative pressure range Y where a suitable negative pressure A in FIG. 8 is obtainable.

Then, the atmosphere opening position F is a position at which the displacement member 205 opens more than at the filled tank position G. The displacement amount of the displacement member 205 between the atmosphere opening position F and the filled tank position G is the above-mentioned count value L of carriage travel distance.

Figure 13:
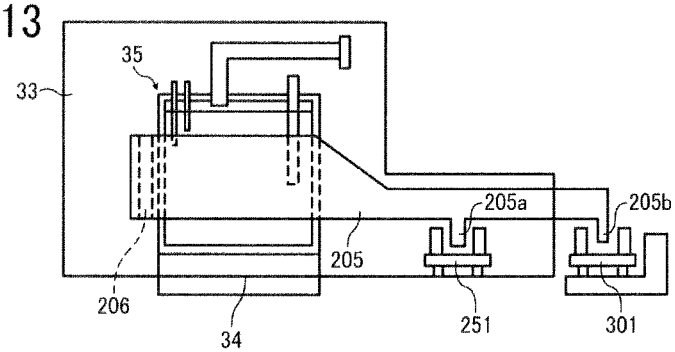
FIG. 13 a schematic view for explaining locations of the first and the second detectors.

Next, a locational example of the first detector and the second detectors is explained, referring to FIG. 13. FIG. 13 a schematic view for explaining the locational example thereof. The displacement member 205 of the head tank 35 includes a detection part 205*a* and a 205*b* having a different length from a support axis 206 (oscillation support point) each other below, and the first detector 251 of the carriage 33 detects the detection part 205*a* and the second detector 301 of the apparatus detects the detection part 205*b*.

Figure 14:
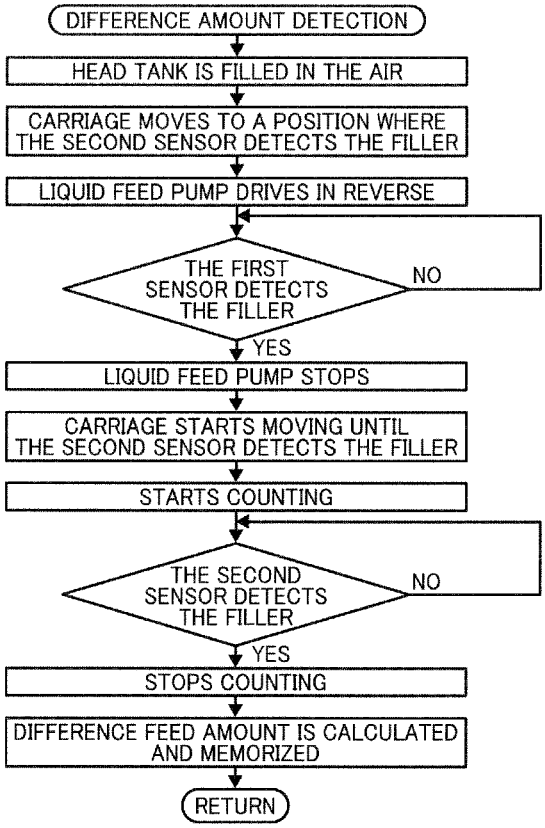
FIG. 14 is a flow chart for explaining for detecting the difference displacement amount by the controller.
Figure 15:
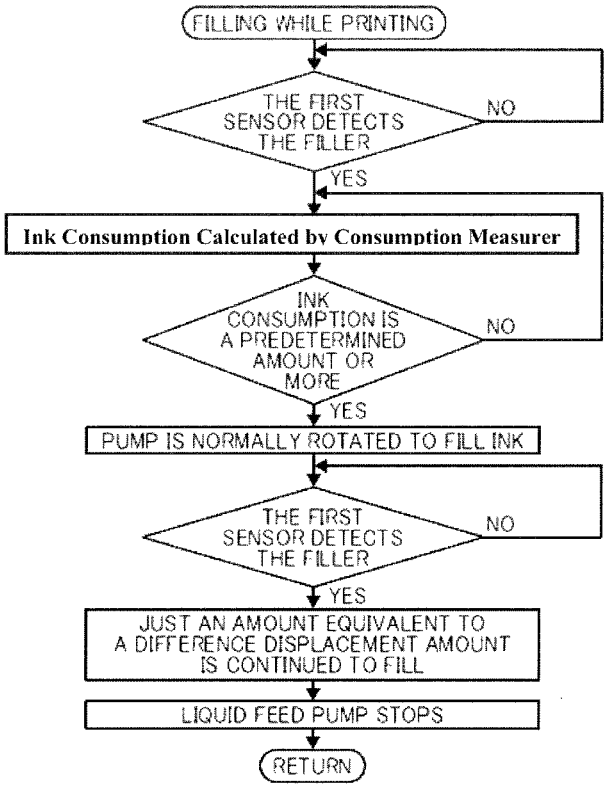
FIG. 15 is a flow chart for explaining filling while printing.

Next, the control of the above-mentioned operation by the controller is explained, referring flow charts in FIGS. 14 and 15.

First, a difference amount detection process in FIG. 14, while the head tank 35 is open to the atmosphere and filled with the ink, the carriage 33 is moved to a position where the second detector 301 detects the displacement member 205 (hereinafter referred to as a "filler" in Figs.). Then, the displacement member 205 of the head tank 35 takes the atmosphere opening position.

Since the displacement member 205 is at the atmosphere opening position until the first detector 251 detects the displacement member 205, the liquid feed pump 241 reverses to suction the ink and stops reversing.

Then, the carriage 33 starts moving to a position where the second detector 301 detects the displacement member 205, the linear encoder 90 starts counting and stops counting when the second detector 301 detects the displacement member 205.

Thus, a displacement amount (difference) of the displacement member 205 between the atmosphere opening position (second position) and the first position when the first detector 251 detects the displacement member 205 is detected, a predetermined displacement amount is reduced from the difference to determine a difference displacement amount, and a liquid amount equivalent to the difference displacement amount is memorized and stored as a difference feed amount. The difference displacement amount itself may be memorized and stored to perform feeding of the difference feed amount which is a liquid amount equivalent to the difference displacement amount when feeding ink.

In FIG. 15, in filling process while printing, when the ink is consumed from the filled tank, the displacement member 205 is displaced in a direction of decrease of the inks in the head tank 35, and whether the first detector 251 detects the displacement member 205 is determined When the displacement member 205 is displaced in a direction of decrease of the inks in the head tank 35 and the first detector 251 detects the displacement member 205, the ink consumption since then is calculated and whether the ink consumption is not less than a predetermined liquid consumption (predetermined amount) is determined.

The ink consumption is calculated by counting the number of drops discharged for forming images or blank discharge while printing, and multiplying the counted value by a drop amount (this is called soft count, which forms a consumption measurer). When the recording head 34 is cleaned by suctioning an ink therefrom, the consumption (suctioned amount) by the suction is predetermined and the suctioned amount is added.

When the ink consumption is not less than a predetermined liquid consumption (predetermined amount), the displacement member 205 takes the feed starting position and the liquid feed pump 241 is driven to normally rotate to fill (feed) an ink from the main tank 10 to the head tank 35.

Then, whether the first detector 251 detects the displacement member 205 of the head tank 35 is determined, and when the first detector 251 detects the displacement member 205 of the head tank 35, the ink in the difference feed amount is further filled in the head tank 35.

As mentioned later, a predetermined displacement amount reduced from the difference is determined in consideration of the filled tank position and the variability, the ink can be filled in the head tank 35 to the filled tank position or its neighborhood (a side where the ink remains less).

Then, the liquid feed pump 241 stops and the calculated value of the ink consumption is reset.

Thus, even while printing, the head tank 35 can be filled with an ink without returning the carriage 33 to its home position.

The head tank includes the displacement member displaced according to a liquid remaining therein, the carriage includes the first detector detecting the displacement member, the apparatus includes the second detector detecting the displacement member, the first position of the displacement member detected by the first detector is a position when the liquid in the head tank remains less than the second a position when the second detector detects the displacement member, and the feed controller detects a displacement amount of the displacement member between the first and the second positions, holds a difference displacement amount determined by reducing a predetermined displacement amount from the detected displacement amount or a difference feed amount equivalent to the difference displacement amount, starts feeding the liquid from the main tank to the head tank when the displacement member is displaced in a direction to decrease of the liquid remaining in the head tank while forming images and the liquid consumption in the head tank becomes a predetermined liquid consumption after the first detector detects the displacement member, and feeds the liquid in the head tank in the difference feed amount equivalent to the difference displacement amount when the displacement member is displaced in a direction to increase of the liquid in the head tank and after the first detector detects the displacement member. Thus, a suitable amount of the liquid can be fed from the main tank to head tank even while forming images, particularly while the carriage is travelling to improve printing speed.

The reason why the apparatus includes the second detector 301 as well in addition to the first detector 251 of the carriage 33 is explained.

First, a position when the head tank 35 is filled changes according to the environment, and the first detector 251 of the carriage 33 cannot detect an amount of the change because of being capable of detecting only one point. The second detector 301of the apparatus can detect the atmosphere opening position and filled tank position by moving carriage 33.

A distance between a fixed detection point on the carriage 33 and a movable detection point when the carriage 33 is moved can be detected by a drive time and a drive rotation number of a pump or encoder count by the carriage movement. Thus, the feed amount control according to environment can be performed.

When sensors and encoders capable of detecting all displacements are loaded only on the carriage 33, cost of the detectors increases, and further the carriage enlarges and the apparatus enlarges.

The liquid feed pumps have variable liquid feed amounts (feed amounts and suction amounts) due to environment, age and their components. Therefore, the second detector 301 of the apparatus sensible to the environment needs to detect the feed amount of the pump. If this is controlled only by a drive amount of the liquid feed pump without the second detector 301 of the apparatus, excess or shortage of feed occurs.

Figure 16:
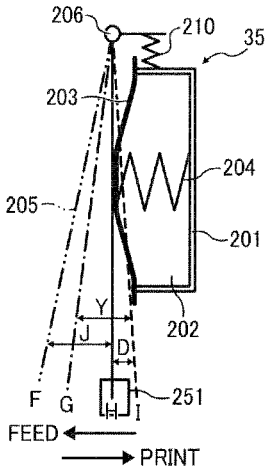
FIG. 16 is a schematic view for explaining each position of the displacement member of the head tank for setting a difference feed amount in the first embodiment of the present invention.
Figure 17:
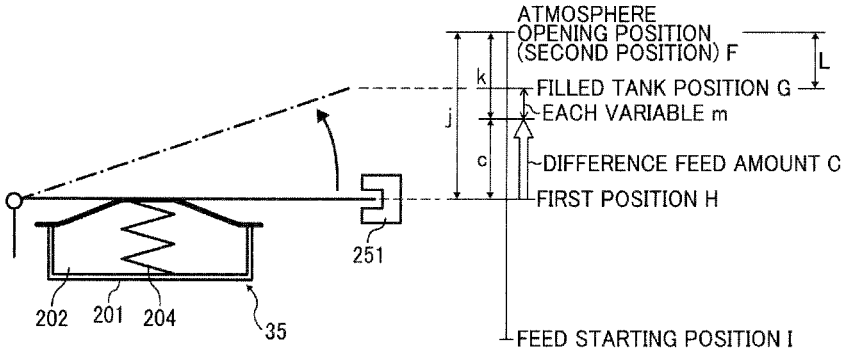
FIG. 17 is a schematic view for explaining a method of determining the difference feed amount in the first embodiment of the present invention.
Figure 18:
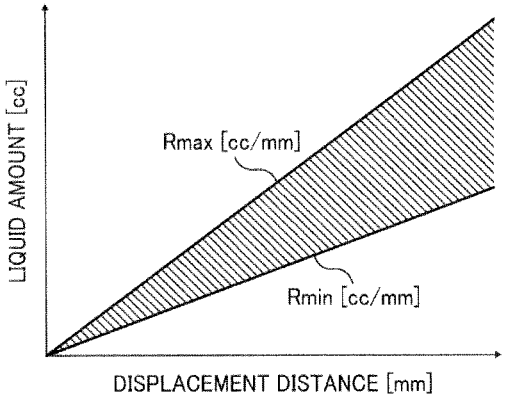
FIG. 18 is a schematic view for explaining an example of variability range of a liquid amount relative to the displacement amount of the displacement member in the first embodiment of the present invention.

Next, setting the difference feed amount in the first embodiment of the present invention is explained, referring to FIG. 16 or FIG. 18. FIG. 16 is a schematic view for explaining each position of the displacement member of the head tank for setting a difference feed amount in the first embodiment of the present invention, FIG. 17 is a schematic view for explaining a method of determining the difference feed amount therein, and FIG. 18 is a schematic view for explaining an example of variability range of a liquid amount relative to the displacement amount of the displacement member therein.

As FIG. 17 shows, a second position the second detector 301 detects is the atmosphere opening position F and a position the first detector 251 detects is a first position H.

The difference feed amount C is determined regarding the atmosphere opening position F as a standard. Namely, the displacement amount of the displacement member 205 with the atmosphere opening position F and the first position H is a displacement distance j. A predetermined distance k is reduced from the displacement distance j to determine a difference displacement amount c, and an amount of ink equivalent thereto is a difference feed amount C.

The displacement distance j between the atmosphere opening position F and the first position H is, as mentioned above, a carriage travel distance after the second detector 301 detects is the displacement member 205 when the head tank 35 is open to the atmosphere, the head tank is filled to reverse the ink, and the carriage 33 travels until the second detector 301 detects is the displacement member 205 while the first detector 251 detects the displacement member 205.

The predetermined distance k includes a distance L from the atmosphere opening position F to the filled tank position G and a predetermined distance m due to variables. The predetermined distance m includes a flop of carriage scanning of the displacement member 205, detected distance variables of the first and second detectors 251 and 301, a detection time variable, a stop lag of the liquid feed pump 241, etc.

The distance (difference displacement amount) c can be converted into a liquid (ink) amount because of a displacement characteristic (R=liquid amount/displacement amount [cc/mm]) of the displacement member 205 of the head tank 35.

As FIG. 18 shows, there is a width of variable between the displacement distance (amount) and the liquid amount (shaded portion). Namely, even the same displacement distance has a width of liquid amount equivalent to the same displacement distance from minimum R min [cc] to maximum R max [cc].

When the difference displacement amount c is converted into the difference feed amount C, the liquid amount of the minimum (R min [cc/mm]) is used to calculate the difference feed amount C. Namely, the liquid amount of the minimum (R min [cc/mm]) equivalent to the difference displacement amount c is the difference feed amount C.

Even when the displacement member 205 has variable displacement amounts, as mentioned above, when the difference feed amount C is fed after the first detector 251 detects the displacement member 205 while printing, it prevents the head tank 35 from being excessively filled over the filled tank position, and the negative pressure from lowering out of suitable negative pressure range.

When the difference feed amount C is fed while forming images, the feed amount is controlled by a liquid feeding time (drive time) of the liquid feeding pump 241. In this case, even when the liquid feeding pump 241 is driven to feed a liquid at a maximum flow rate, the liquid is fed for a time t so as not to exceed the difference feed amount C.

Thus, when the difference feed amount C is fed while printing after the first detector 251 detects the displacement member 205, it prevents the head tank 35 from being excessively filled over the filled tank position, and the negative pressure from lowering out of suitable negative pressure range.

The predetermined distance m may be a variable due to temperature and humidity environment. Thus, suitable dischargeability can be obtained according to usage environment.

Figure 19:
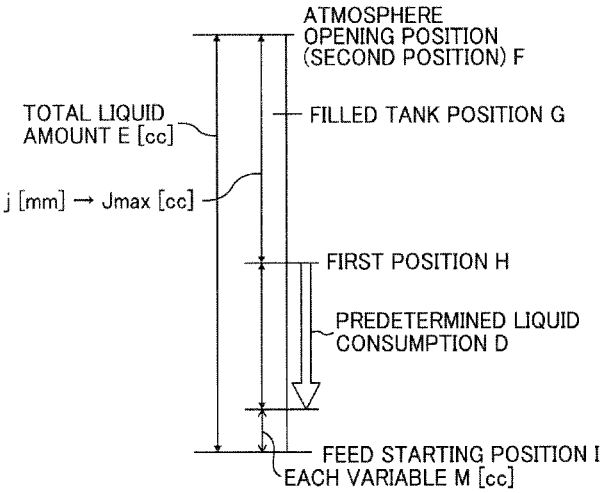
FIG. 19 is a schematic view for explaining setting a predetermined liquid consumption in a second embodiment of the present invention.

Next, setting a predetermined liquid consumption to determine a feed starting position while printing in a second embodiment of the present invention is explained, referring to FIG. 19.

A predetermined liquid consumption D is determined regarding a total liquid amount E head tank 35 uses and the atmosphere opening position F (the displacement distance j) as a standards.

The predetermined liquid consumption D is determined by reducing a maximum liquid amount J (Rmax [cc]) equivalent to the displacement distance j and a predetermined liquid amount M equivalent each variable from the total liquid amount E, which dos not change even when the consumption count by the soft count differs from the actual discharged amount at a maximum, i.e., even when the measurement error is a predetermined maximum value.

The predetermined liquid amount F includes variables of feed amount due to a flop of carriage scanning of the displacement member 205, detected distance variables of the first and second detectors 251 and 301, a detection time variable, a stop lag of the liquid feed pump 241, etc.

Thus, even when the predetermined liquid consumption D is minimum due to a variable difference between the displacement distance and the liquid amount conversion, and further the actual consumption is larger than a consumption obtained by the soft count, the nozzle down because of consuming the ink too much is prevented.

The liquid amount F may be a variable due to temperature and humidity environment.

Figure 20:
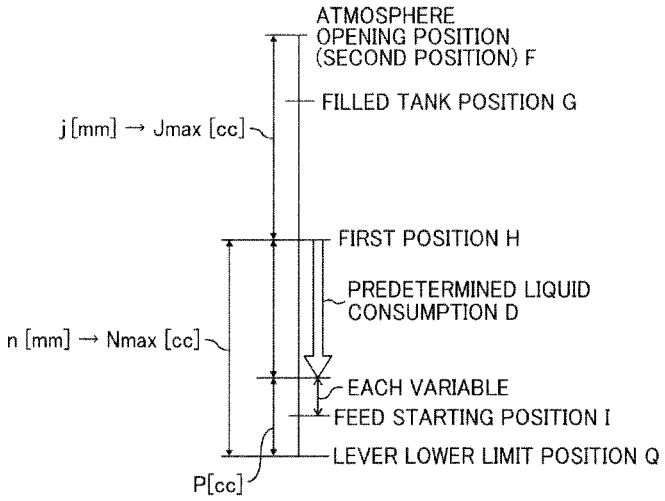
FIG. 20 is a schematic view for explaining setting a predetermined liquid consumption in a third embodiment of the present invention.

Next, setting a predetermined liquid consumption to determine a feed starting position while printing in a third embodiment of the present invention is explained, referring to FIG. 20.

The predetermined liquid consumption D is set regarding a lower limit position of the displacement member 205 of the head tank 35, i.e., a position where the displacement member 205 is not displaced any longer in a direction of decrease of the liquid remaining in the head tank 35 (a lever lower limit position) as a standard.

The predetermined liquid consumption D does not exceed a difference between a minimum liquid amount N (Rmin [cc]) equivalent to a distance n from the lever lower limit position of the displacement member 205 to the first position when the first detector 251 detects the displacement member 205 and a predetermined liquid amount P (the lever lower limit position+each variable) even when the consumption count by the soft count differs from the actual discharged amount at a maximum.

The predetermined liquid amount P is an allowable ink consumption prior to the position where the displacement member 205 is no longer displaced. This includes each variable as well.

Thus, even when the predetermined liquid consumption D is minimum due to a variable difference between the displacement distance and the liquid amount conversion, and further the actual consumption is larger than a consumption obtained by the soft count, the nozzle down because of consuming the ink too much is prevented.

The predetermined liquid amount P may be a variable due to temperature and humidity environment. The predetermined liquid amount P may have a negative value if the ink can further be used after the displacement member 205 reaches the position where it is no longer displaced.

Figure 21:
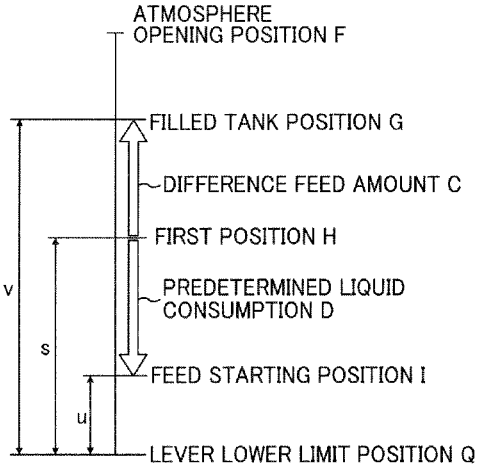
FIG. 21 is a schematic view for explaining setting a difference feed amount and a predetermined liquid consumption in a fourth embodiment of the present invention.

A fourth embodiment of the present invention is explained, referring to FIG. 21. FIG. 21 is a schematic view for explaining setting a difference feed amount and a predetermined liquid consumption therein.

The first detector 251 detects a position from the filled tank position to the feed staring position as a first position H. The second detector 301 detects a lower limit position of the liquid remaining in the head tank 35, i.e., a lever lower limit position where the displacement member 205 is not displaced any longer in a direction of decrease of the liquid remaining therein as a second position Q.

The first position H is a position when the liquid remains in the head tank 35 in an amount larger than the second position (lever lower limit position).

A liquid amount equivalent to a first difference displace amount (distance) determined by reducing a first predetermined distance (displacement amount) u (a distance between the second position Q and the feed starting position I) from a displacement distance s between the first position H and the second position Q is memorized and stored as a predetermined liquid consumption D.

A liquid amount equivalent to a second difference displacement amount (distance)determined by reducing a displacement distance s between the first position H and the second position Q from second predetermined distance (displacement amount) v (a distance between the second position Q and the filled tank position G) is memorized and stored as a difference feed amount C.

When an ink is fed from the main tank 10 to the head tank 35 while printing, feeding the ink from the main tank 10 to the head tank 35 starts when the predetermined liquid consumption D is used from a position when the first detector 251 detects the displacement member 205, and then the ink in the difference feed amount C is fed in the head tank 35.

Namely, this embodiment does not use the atmosphere opening position and includes the predetermined liquid consumption D and the difference feed amount C regarding the position where the displacement member is not displaced any longer and the first position by the first detector as standards.

Each of the first and second predetermined distances u and v may be fixed or a variable due to temperature and humidity environment, inconsideration of each variable and solid variability of the head tank 35.

Thus, waste of ink when detecting a displacement amount of the displacement member between the detected position by the first detector 251 and the atmosphere opening position can be avoided.

Figure 22:
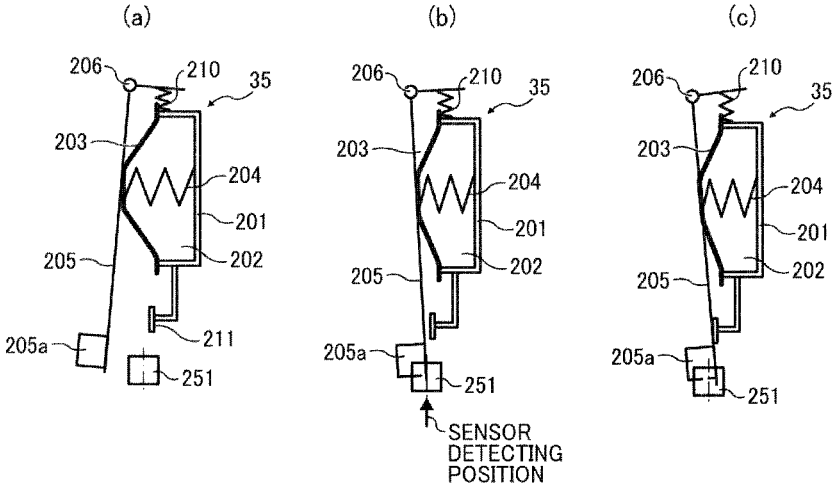
FIGS. 22A, 22B and 22C are schematic views for explaining a fifth embodiment of the present invention.

A fifth embodiment of the present invention is explained, referring to FIGS. 22A to 22C. FIGS. 22A, 22B and 22C are schematic views for explaining the fifth embodiment thereof.

The displacement member 205 of the head tank 35 has a width in a displacement direction such that the detection part 205*a* of the displacement member 205 is invariably one when the first detector 251 detects the displacement member 205.

Namely, when the displacement member 205 has a narrow width, and due to each variable, solid variability of the head tank 35 and a flop of the displacement member 205, a difficult control is needed to determine which end of the displacement member 205 in the displacement direction detects.

When the detection part 205*a* of the displacement member 205 has a sufficient width, as FIG. 22A shows, when the first detector 251 is off (does not detect), the displacement member 205 invariably takes a side where the liquid remains more than the first detector 251, and as FIG. 22B or 22C shows, when the first detector 251 is on (detects), the displacement member 205 invariably takes a side where the liquid remains less than the first detector 251. The detection can be made at a desired position.

The head tank 35 includes a lever contactor 211 specifying a lower limit position of the displacement member 205 in a direction of decrease of the liquid remaining in the tank.

This improves preciseness of the lever lower limit position where the displacement member 205 is not displaced any longer in a direction of the liquid remaining in the tank.

Figure 23:
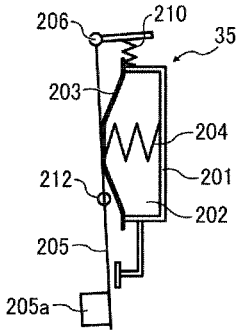
FIG. 23 is a schematic view for explaining a sixth embodiment of the present invention.

A sixth embodiment of the present invention is explained, referring to FIG. 23. FIG. 23 is a schematic view for explaining the sixth embodiment thereof.

In this embodiment, the support axis 206 is located close to the gravity center 212 of the displacement member 205.

Therefore, the inertia by scanning of the carriage 23 becomes small and the displacement member 205 decreases in flopping.

The spring 210 biasing the displacement member 205 biases the displacement member 205 at a biasing force stronger than a rotational inertia force applied thereto by scanning of the carriage 23.

This decreases the inertia by scanning of the carriage 23 as well and the displacement member 205 decreases in flopping.

Figure 24:
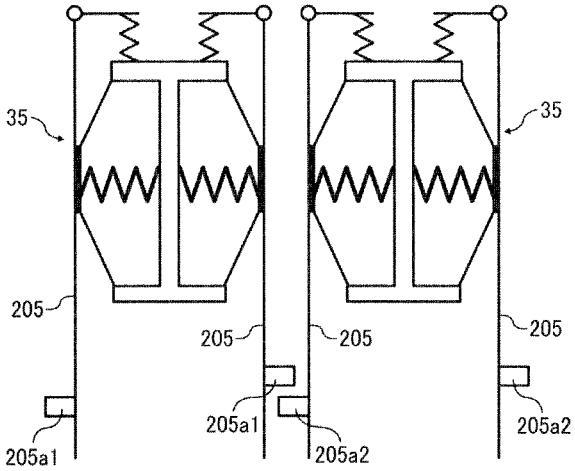
FIG. 24 is a schematic plain view of the head tank location for explaining a seventh embodiment of the present invention.
Figure 25:
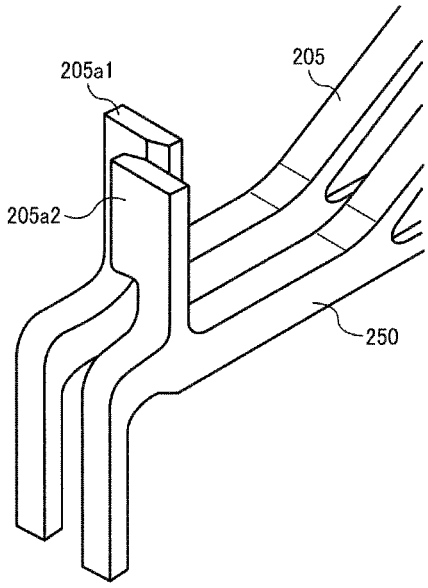
FIG. 25 is a perspective view for explaining the main part of the displacement member of the head tank in FIG. 24.

A seventh embodiment of the present invention is explained, referring to FIGS. 24 and 25. FIG. 24 is a schematic plain view of the head tank location for explaining a seventh embodiment of the present invention, and FIG. 25 is a perspective view for explaining the main part of the displacement member of the head tank therein.

As mentioned above, two head tanks 35 are located on the carriage 23 in parallel. The adjacent displacement members 205 of the adjacent head tanks 35 have detected parts 205*a*1 and 205*a*2 detected by the first detector 251 alternately.

Namely, when plural head tanks 35 are located at a narrow interval, the location of the first detector 251 is limited and the displacement member 205 is located at a desired position. Then, when the adjacent displacement members 205 interfere with each other, they are not precisely be detected. Therefore, the detected parts 205*a*1 and 205*a*2 are shifted in an extension direction of the displacement member 205 so as to be precisely be detected by the first detector 251.

The control (process) of the ink feed operation to the head tank is executed by a computer with a program stored in the ROM 502. The program may be downloaded in the image processor (host 600) and installed in the image forming apparatus. Either of a combination of the image forming apparatus of the present invention and the image processor or a combination of an image forming apparatus and the image processor having the program executing the process of the present invention.

In the present invention, the sheet is not limited to a paper, and includes an OHP, a cloth, a glass, a substrate, etc., which an ink drop and other liquids can adhere to. A recorded medium, a recording medium, a recoding paper, a recording sheet are included as well. The image forming, recording, printing, transferring and pressing all have the same meaning.

The image forming apparatus discharges a medium such as a liquid to papers, threads, fibers, clothes, leathers, metals, plastics, glasses, woods and ceramics to form an image thereon. The image formation means not only forming images having meanings such as letters and figures on a medium but also forming images having no meaning such as pattern images thereon (simply dropping a droplet thereon).

The ink includes all liquids capable of forming images, such as recording liquids and fixing liquids unless otherwise specified, e.g., DNA samples, resist, pattern materials, resins, etc. are included as well.

The image is formed not only on a plane medium but also on a stereoscopic medium. An image formed by three-dimensionally shaping the stereoscopic medium is included as well.

The image forming apparatus includes both of a serial image forming apparatus and a line image forming apparatus unless otherwise specified.

Having now fully described the invention, it will be apparent to one of ordinary skill in the art that many changes and modifications can be made thereto without departing from the spirit and scope of the invention as set forth therein.

What is claimed is:

1. An image forming apparatus, comprising:

a recording head configured to discharge a droplet;

a head tank configured to contain a liquid fed to the recording head;

a carriage configured to mount the recording head and the head tank;

a main tank configured to contain the liquid fed to the head tank;

a liquid feeder configured to feed the liquid from the main tank to the head tank; and a feed controller configured to control feeding of the liquid from the main tank to the head tank, wherein the head tank comprises a displacement member configured to be displaced according to an amount of the liquid remaining therein;

the carriage comprises a first detector configured to detect the displacement member; and the image forming apparatus comprises a second detector configured to detect the displacement member, wherein a first position of the displacement member detected by the first detector is a position when an amount of the liquid remaining in the head tank is less than that thereof remaining therein at a second position of the displacement member detected by the second detector, and the feed controller detects a displacement amount of the displacement member between the first and second positions, holds a difference displacement amount or a difference feed amount equivalent thereto, which is determined by reducing a predetermined displacement amount from the detected displacement amount, starts feeding the liquid from the main tank to the head tank after the displacement member is displaced in a direction of decrease of the liquid amount remaining in the head tank and a consumption of the liquid in the head tank after the first detector detects the displacement member becomes a predetermined liquid consumption, and feeds the liquid to the head tank in the difference feed amount equivalent to the difference displacement amount after the displacement member is displaced in a direction of increase of the liquid amount remaining in the head tank and the first detector detects the displacement member.

2. The image forming apparatus of claim 1, wherein he feed controller controls driving the liquid feeder in a time such that an amount of the liquid fed when the liquid feeder is driven at a maximum does not exceed the difference feed amount equivalent to the difference displacement amount, when feeding the liquid to the head tank in the difference feed amount equivalent to the difference displacement amount.

3. The image forming apparatus of claim 1, wherein the predetermined liquid consumption is determined by reducing a liquid amount equivalent to a displacement amount of the displacement member between the first and second positions and a predetermined liquid amount from a predetermined total liquid amount containable in the head tank.

4. The image forming apparatus of claim 1, further comprising a consumption measurer configured to measure the liquid consumption, wherein the predetermined liquid consumption does not exceed a liquid amount determined by reducing a liquid amount equivalent to a displacement amount of the displacement member between the first and second positions and a predetermined liquid amount from a predetermined total liquid amount containable in the head tank even when the consumption measurer has a predetermined maximum measuring error.

5. The image forming apparatus of claim 1. wherein the predetermined liquid consumption is determined by reducing a predetermined liquid amount from a displacement amount of the displacement member between a position where the displacement member is not displaced any more in a direction of decrease of the liquid amount remaining in the head tank and the first position where the first detector detects the displacement member.

6. The image forming apparatus of claim 1, further comprising a consumption measurer configured to measure the liquid consumption, wherein the predetermined liquid consumption does not exceed a liquid amount determined by reducing a predetermined liquid amount from a displacement amount of the displacement member between a position where the displacement member is not displaced any more in a direction of decrease of the liquid amount remaining in the head tank and the first position where the first detector detects the displacement member even when the consumption measurer has a predetermined maximum measuring error.

7. The image forming apparatus of claim 1, wherein the head tank comprises:

a tank configured to form a container containing the liquid;

a flexible member configured to form a wall surface of the container;

a spring configured to bias the flexible member in a direction of enlarging a capacity of the container, wherein the displacement member is oscillatably located while pressed to the flexible member at the outer side of the container at a pressing force larger than a rotational inertia force applied to the displacement member when the carriage is scanned.

8. The image forming apparatus of claim 1, further comprising a plurality of head tanks and a plurality of displacement members, wherein more than one of the head tanks are collaterally loaded on the carriage, and parts of the displacement members of the head tanks detected by the first detector are alternately located. member even when the consumption measurer has a predetermined maximum measuring error.

9. An image forming apparatus, comprising:

a recording head configured to discharge a droplet;

a head tank configured to contain a liquid fed to the recording head;

a carriage configured to mount the recording head and the head tank;

a main tank configured to contain the liquid fed to the head tank;

a liquid feeder configured to feed the liquid from the main tank to the head tank; and a feed controller configured to control feeding of the liquid from the main tank to the head tank.

wherein the head tank comprises a displacement member configured to be displaced according to an amount of the liquid remaining therein;

the carriage comprises a first detector configured to detect the displacement member and a first position where the displacement member is located between a filled tank position and a feed starting position, and the image forming apparatus comprises a second detector configured to detect the displacement member and a second position where the displacement member is not displaced any more in a direction of decrease of the liquid amount remaining in the head tank, wherein the first position of the displacement member detected by the first detector is a position when an amount of the liquid remaining in the head tank is greater than that thereof remaining therein at a second position of the displacement member detected by the second detector, and the feed controller holds a liquid amount equivalent to a first difference displacement amount as a predetermined liquid consumption, which is determined by reducing a predetermined first displacement amount from a displacement amount of the displacement member between the first and second positions, holds a second difference displacement amount or a second difference feed amount equivalent thereto, which is determined by reducing the displacement amount of the displacement member between the first and second positions from the displacement amount of the displacement member between the second position and the filled tank position, starts feeding the liquid from the main tank to the head tank after the displacement member is displaced in a direction of decrease of the liquid amount remaining in the head tank and a consumption of the liquid in the head tank after the first detector detects the displacement member becomes the predetermined liquid consumption, and feeds the liquid to the head tank in the difference feed amount equivalent to the difference displacement amount after the displacement member is displaced in a direction of increase of the liquid amount remaining in the head tank and the first detector detects the displacement member.

10. The image forming apparatus of claim 9, wherein the head tank comprises a contactor configured to regulate a displacement limit of the displacement member in the direction of decrease of the liquid amount remaining in the head tank.

11. The image forming apparatus of claim 9, wherein the head tank comprises:

a tank configured to form a container containing the liquid;

a flexible member configured to form a wall surface of the container;

a spring configured to bias the flexible member in a direction of enlarging a capacity of the container, wherein the displacement member s oscillatably located while pressed to the flexible member at the outer side of the container at a pressing force larger than a rotational inertia force applied to the displacement member when the carriage is scanned.

12. The image forming apparatus of claim 9, further comprising a plurality of head tanks and a plurality of displacement members, wherein more than one of the head tanks are collaterally loaded on the carriage, and parts of the displacement members of the head tanks detected by the first detector are alternately located.

* * * * *